US008325041B2

(12) United States Patent
August et al.

(10) Patent No.: US 8,325,041 B2
(45) Date of Patent: Dec. 4, 2012

(54) FIREARM VISIBILITY NETWORK

(75) Inventors: Jason August, Toronto (CA); John Stevens, Stratham, NH (US); Paul Waterhouse, Copetown (CA)

(73) Assignee: Visible Assets, Inc., Mississauga, Ontario (CA)

( * ) Notice: Subject to any disclaimer, the term of this patent is extended or adjusted under 35 U.S.C. 154(b) by 1259 days.

(21) Appl. No.: 12/108,877

(22) Filed: Apr. 24, 2008

(65) Prior Publication Data

US 2010/0265071 A1 Oct. 21, 2010

Related U.S. Application Data

(60) Provisional application No. 60/913,656, filed on Apr. 24, 2007.

(51) Int. Cl.
*H04Q 5/22* (2006.01)
*G08B 13/14* (2006.01)

(52) U.S. Cl. ..... 340/572.1; 340/572.7; 340/10.1; 340/10.42

(58) Field of Classification Search ..... None
See application file for complete search history.

(56) References Cited

U.S. PATENT DOCUMENTS 6,362,738 B1 * 3/2002 Vega ..... 340/572.1
7,049,963 B2 * 5/2006 Waterhouse et al. ..... 340/572.1
7,277,014 B1 * 10/2007 Waterhouse et al. ..... 340/572.1
2004/0257231 A1 * 12/2004 Grunes et al. ..... 340/572.1
2005/0093702 A1 * 5/2005 Twitchell, Jr. ..... 340/572.8
2006/0109083 A1 * 5/2006 Rathus et al. ..... 340/10.1
2006/0214766 A1 * 9/2006 Ghabra et al. ..... 340/5.25
2007/0008141 A1 * 1/2007 Sweetland ..... 340/572.7
2007/0035383 A1 * 2/2007 Roemerman et al. ..... 340/10.1
2007/0063895 A1 * 3/2007 August et al. ..... 342/359
2008/0074262 A1 * 3/2008 Paulkovich ..... 340/572.1
2008/0191847 A1 * 8/2008 August et al. ..... 340/10.42
2008/0258930 A1 * 10/2008 Demichele et al. ..... 340/691.1
2008/0284600 A1 * 11/2008 Drzaic et al. ..... 340/572.1
2009/0021343 A1 * 1/2009 Sinha ..... 340/5.2
2009/0212117 A1 * 8/2009 August et al. ..... 235/492
2009/0219156 A1 * 9/2009 August et al. ..... 340/572.1
2010/0141401 A1 * 6/2010 Twitchell, Jr. ..... 340/10.33
2010/0289627 A1 * 11/2010 McAllister et al. ..... 340/10.42
2011/0133904 A1 * 6/2011 Warther ..... 340/10.5
2011/0298582 A1 * 12/2011 August et al. ..... 340/5.8

* cited by examiner

*Primary Examiner* — Julie Lieu
(74) *Attorney, Agent, or Firm* — Larson & Anderson, LLC

(57) ABSTRACT

A system for identifying, monitoring, and tracking a firearm includes: a low frequency radio tag affixed to the firearm, the radio tag configured to receive and send data signals, the radio tag including: a tag antenna operable at a low radio frequency not exceeding 450 kilohertz, a transceiver operatively connected to the tag antenna, the transceiver configured to transmit and receive data signals at the low radio frequency; a data storage device configured to store data including identification data for identifying the firearm, and a data processor configured to process data received from the transceiver and the data storage device and to transmit data to cause the transceiver to emit an identification signal based upon the identification data stored in the data storage device.

34 Claims, 12 Drawing Sheets

FIREARMS MAYBE STORED ON SHELVES WITH FULL PHYSICAL INVENTORY, CHECK IN CHECK OUT AND USE RECORDS. FIREARMS MAYBE STORED IN ORIGINAL BOX'S OR ON SPECIALIZED SHELF

FIREARM PHYSICAL INVENTORY EACH 10 MINUTES 24 HOURS PER DAY

WEB ENABLED REPORTS AND CHAIN OF CUSTODY ARE CREATED BY DOT-TAG

FIREARM VISIBILITY NETWORK

CROSS-REFERENCE TO RELATED APPLICATIONS

This application is a non-provisional of, and claims priority from, U.S. Application Ser. No. 60/913,656, filed Apr. 24, 2007, which is incorporated by reference as if fully set forth herein.

STATEMENT REGARDING FEDERALLY SPONSORED-RESEARCH OR DEVELOPMENT

None.

INCORPORATION BY REFERENCE OF MATERIAL SUBMITTED ON A COMPACT DISC

None.

TRADEMARKS

RuBee® is a registered trademark of Visible Assets, Inc. of the United States of America. Other names used herein may be registered trademarks, trademarks or product names of Visible Assets, Inc. or other companies.

FIELD OF THE INVENTION

This invention relates to a system and method for identifying, detecting and animate and inanimate objects. The invention also relates to novel radio frequency detection tags which are capable of communicating data, such as identification and positional data. In a preferred application, the novel tags can give an active pre-emptive status warning about damage (e.g. due to shock) or a deteriorating condition (e.g. overheating) of the objects to which they are attached.

SUMMARY OF THE INVENTION

Briefly, according to an embodiment of the present invention, a system for identifying, monitoring, and tracking a firearm includes: a low frequency radio tag affixed to the firearm, the radio tag configured to receive and send data signals, the radio tag including: a tag antenna operable at a low radio frequency not exceeding 450 kilohertz, a transceiver operatively connected to the tag antenna, the transceiver configured to transmit and receive data signals at the low radio frequency; a data storage device configured to store data including identification data for identifying the firearm, and a data processor configured to process data received from the transceiver and the data storage device and to transmit data to cause the transceiver to emit an identification signal based upon the identification data stored in the data storage device.

BRIEF DESCRIPTION OF THE DRAWINGS

To describe the foregoing and other exemplary purposes, aspects, and advantages, we use the following detailed description of an exemplary embodiment of the invention with reference to the drawings, in which.

Figure 1:
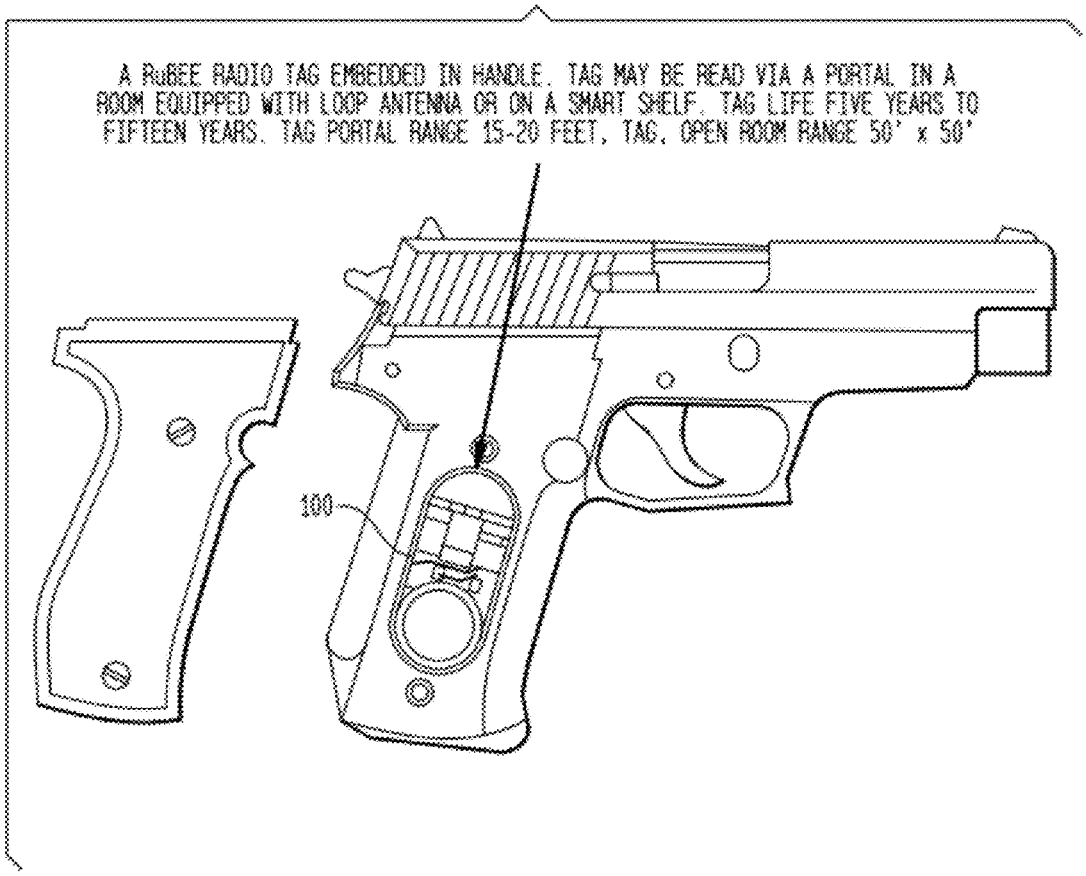
FIG. 1 shows a RuBee radio tag embedded in the handle of a SIG SAUER® handgun, according to an embodiment of the present invention.

While the invention as claimed can be modified into alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the scope of the present invention.

DETAILED DESCRIPTION

We describe a long wave RuBee® active tag system and method for identifying, monitoring and tracking firearms within a network. RuBee® is a radio tag technology designed to provide full asset visibility and identification in harsh environments. The tags use the standard, IEEE P1902.1, "RuBee Standard for Long Wavelength Network Protocol," which allows for networks encompassing thousands of radio tags operating below 450 KHz. RuBee® networks provide for real-time tracking under harsh environments, e.g., near metal and water and in the presence of electromagnetic noise. RuBee® radio tags, which can be either active or passive, have proven battery lives of ten years or more using inexpensive lithium batteries. The tags are programmable, in contrast to RFID tags.

The RuBee® Firearm Visibility Network (FVN) provides full visibility for storage, transport, and use of handguns, rifles, revolvers, and other weapons in high security government and law enforcement (LE) settings. The FVN may optionally include electronic identity cards to tie specific individuals to use/transport of weapons. See "Low Frequency Wireless Identification Device," U.S. application Ser. No. 11/633,751 filed Dec. 4, 2006. The Firearm Visibility Platform may also provide independent audit trails for use in transport and storage of firearms that meet 21CFRPart11 compliance regulations and adhere to the Department of Defense (DoD) Directive 5015.2, "Department of Defense Records Management Program," providing implementation and procedural guidance on records management in the DoD.

Background on RuBee® Radio Tags.

Radio tags communicate via magnetic (inductive communication) or electric radio communication to a base station or reader, or to another radio tag. A RuBee™ radio tag works through water and other bodily fluids, and near steel, with an eight to fifteen foot range, a five to ten-year battery life, and three million reads/writes. It operates at 132 KHz and is a full on-demand peer-to-peer, radiating transceiver.

RuBee® is a bidirectional, on-demand, peer-to-peer transceiver protocol operating at wavelengths below 450 KHz (low frequency). A transceiver is a radiating radio tag that actively receives digital data and actively transmits data by providing power to an antenna. A transceiver may be active or passive. The RuBee® standard is documented in the IEEE Standards body as IEEE P1902.1™.

Low frequency (LF), active radiating transceiver tags are especially useful for visibility and for tracking both inanimate and animate objects with large area loop antennas over other more expensive active radiating transponder high frequency (HF)/ultra high frequency (UHF) tags. These LF tags function well in harsh environments, near water and steel, and may have full two-way digital communications protocol, digital static memory and optional processing ability, sensors with memory, and ranges of up to 100 feet. The active radiating transceiver tags can be far less costly than other active transceiver tags (many under one dollar), and often less costly than passive back-scattered transponder RFID tags, especially those that require memory and make use of EEPROM. With an optional on-board crystal, these low frequency radiating transceiver tags also provide a high level of security by providing a date-time stamp, making full AES (Advanced Encryption Standard) encryption and one-time pad ciphers possible.

One of the advantages of the RuBee® tags is that they can transmit well through water and near steel. This is because RuBee® operates at a low frequency. Low frequency radio tags are immune to nulls often found near steel and liquids, as in high frequency and ultra high-frequency tags. This makes them ideally suited for use with firearms made of steel. Fluids have also posed significant problems for current tags. The RuBee® tag works well through water. In fact, tests have shown that the RuBee® tags work well even when fully submerged in water. This is not true for any frequency above 1 MHz. Radio signals in the 13.56 MHz range have losses of over 50% in signal strength as a result of water, and anything over 30 MHz have losses of 99%.

Another advantage is that RuBee® tags can be networked. One tag is operable to send and receive radio signals from another tag within the network or to a reader. The reader itself is operable to receive signals from all of the tags within the network. These networks operate at long-wavelengths and accommodate low-cost radio tags at ranges to 100 feet. The standard, IEEE P1902.1™, "RuBee Standard for Long Wavelength Network Protocol," will allow for networks encompassing thousands of radio tags operating below 450 KHz.

The inductive mode of the RuBee® tag uses low frequencies, 3-30 kHz VLF or the Myriametric frequency range, 30-300 kHz LF in the Kilometric range, with some in the 300-3000 kHz MF or Hectometric range (usually under 450 kHz). Since the wavelength is so long at these low frequencies, over 99% of the radiated energy is magnetic, as opposed to a radiated electric field. Because most of the energy is magnetic, antennas are significantly (10 to 1000 times) smaller than ¼ wavelength or 1/10 wavelength, which would be required to efficiently radiate an electrical field. This is the preferred mode.

As opposed to the inductive mode radiation above, the electromagnetic mode uses frequencies above 3000 kHz in the Hectometric range, typically 8-900 MHz, where the majority of the radiated energy generated or detected may come from the electric field, and a ¼ or 1/10 wavelength antenna or design is often possible and utilized. The majority of radiated and detected energy is an electric field.

RuBee® tags are also programmable, unlike RFID tags. The RuBee® tags may be programmed with additional data and processing capabilities to allow them to respond to sensor-detected events and to other tags within a network.

Referring now in specific detail to the drawings and particularly FIG. 1, there is shown a RuBee® radio tag 100 embedded in the handle or grip of a handgun, according to an embodiment of the present invention. As shown in FIG. 1, the radio tag 100 is small enough to easily fit into a hollow formed into the grip of the handgun. The firearm shown in this example is a SIG SAUER® handgun, but the invention as discussed is not limited to handguns. The radio tag 100 could be advantageously used with any type of firearm or indeed most types of weaponry (swords, knives, and so forth) and some ammunition.

The radio tag 100 as shown in this example is placed in the handgun grip, but it could be placed in another part of the firearm if a different firearm form factor is used. The placement of the radio tag 100 depends on the form factor of the weapon and the size of the weapon. The tag 100 in this example is embedded into a cavity of the inside of the grip. Embedding the tag 100 in this manner is the preferred embodiment. Alternatively, the tag 100 may be affixed to the firearm by attaching it to the outside surface of the weapon, but this is not recommended.

The tag 100 may be constructed with a waterproof housing made to sustain wear and tear, yet remain lightweight.

Basic Embodiment

Figure 11:
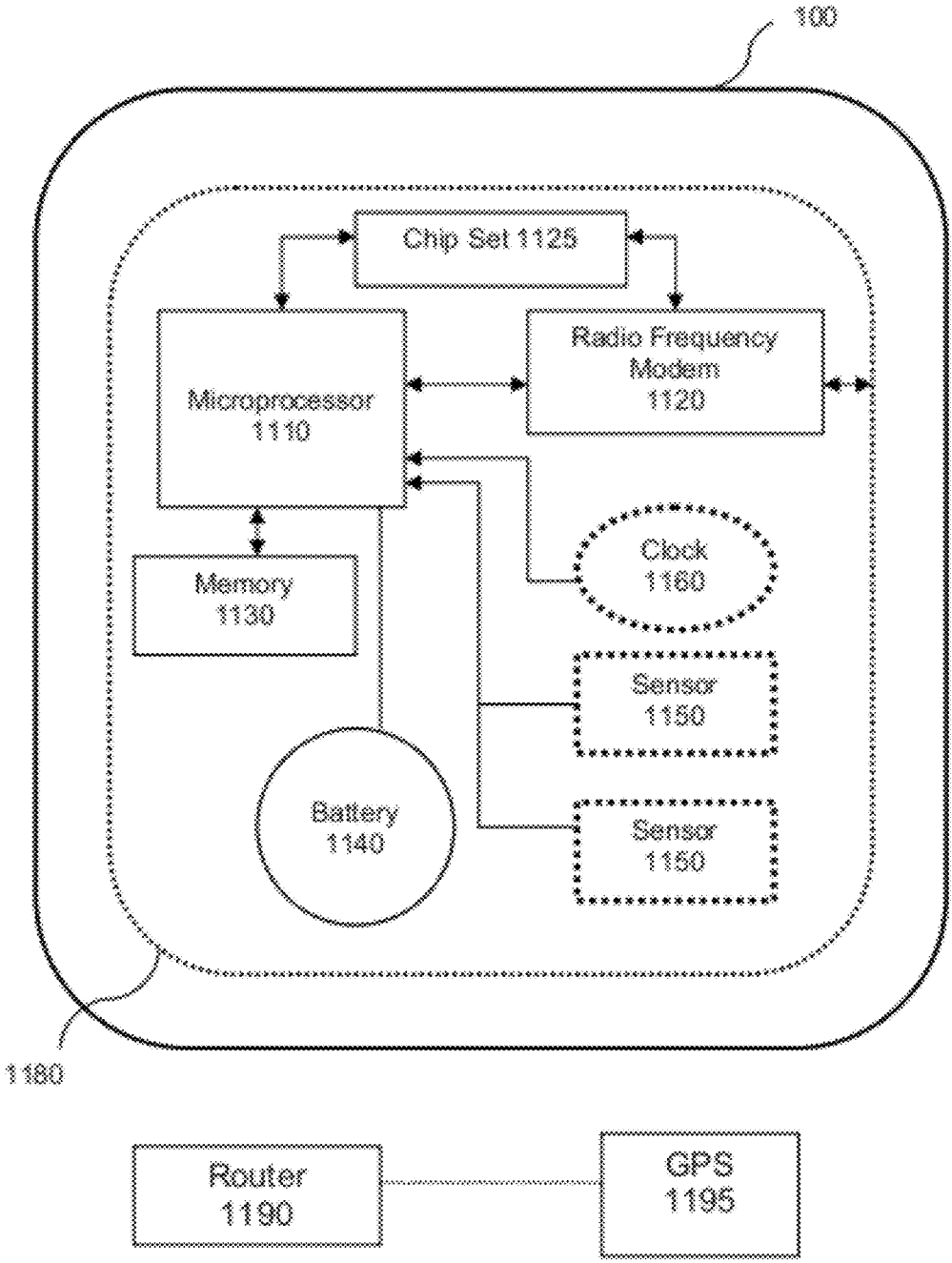
FIG. 11 is a block diagram of the components of the radio tag, according to an embodiment of the present invention.

FIG. 11 is a simplified diagram showing the functional components of the radio tag 100 according to an embodiment of the present invention. The basic components of the tag 100 are: a RuBee® modem 1120, a RuBee® chipset 1125, an antenna 1180, an energy source 1140, a microprocessor 1110, and a memory 1130. In addition to these basic components, the tag 100 may also contain optional components to increase its functionality. These optional components are shown with dashed lines in FIG. 11 and they will be discussed in detail later on in this discussion.

Continuing with the discussion of the basic components, the tag 100 contains a custom RuBee® radiofrequency modem 1120, preferably created on a custom integrated circuit using four micron CMOS (complementary metal-oxide semiconductor) technology. This custom modem 1120 is a transceiver, designed to communicate (transmit and receive radio signals) through an omni-directional loop antenna 1180. All communications take place at very low frequencies (e.g. under 300 kHz). By using very low frequencies the range of the tag 100 is somewhat limited; however power consumption is also greatly reduced. Thus, the receiver of modem 1120 may be on at all times and hundreds of thousands of communication transactions can take place, while maintaining a life of many years (up to 15 years) for battery 1140.

Operatively connected to the modem 1120 is a RuBee® chipset 1125. The chipset 1125 is configured to detect and read analog voltages. The chipset 1125 is operatively connected to the modem 1120 and the microprocessor 1110.

The antenna 1180 shown in FIG. 11 is a small loop antenna with a range of eight to fifteen feet. It is preferably a thin wire wrapped many times around the inside edge of the tag housing. A reader or monitor may be placed anywhere within that range in order to read signals transmitted from the tag 100 or the tag's sensor(s).

The energy source shown in this example is a battery 1140, preferably a lithium (Li) CR2525 battery approximately the size of an American quarter-dollar with a five to fifteen year life and up to three million read/writes. Note that only one example of an energy source is shown. The tag 100 is not limited to a particular source of energy, the only requirement is that the energy source is small in size, lightweight, and operable for powering the electrical components.

The tag 100 also includes a memory 1130 and a four bit microprocessor 1110, using durable, inexpensive 4 micron CMOS technology and requiring very low power.

What has been shown and discussed so far is a basic embodiment of the tag 100. With the components as discussed, the tag 100 can perform the following functions: 1) the tag 100 can be configured to receive (via the modem 1120) and store data about the firearm to which it is attached and/or the network to which it belongs (in the memory 1130); 2) the tag 100 can emit signals which are picked up by a reader, the signals providing data about the firearm; 3) the tag 100 can store data in the form of an internet protocol address so that the tag's data can be read on the internet.

Note that the electrical components of the tag 100 are housed within the body of the tag 100 and are completely enclosed within the tag 100 when the device is sealed. This makes the tag 100 waterproof and tamperproof.

Figure 2:
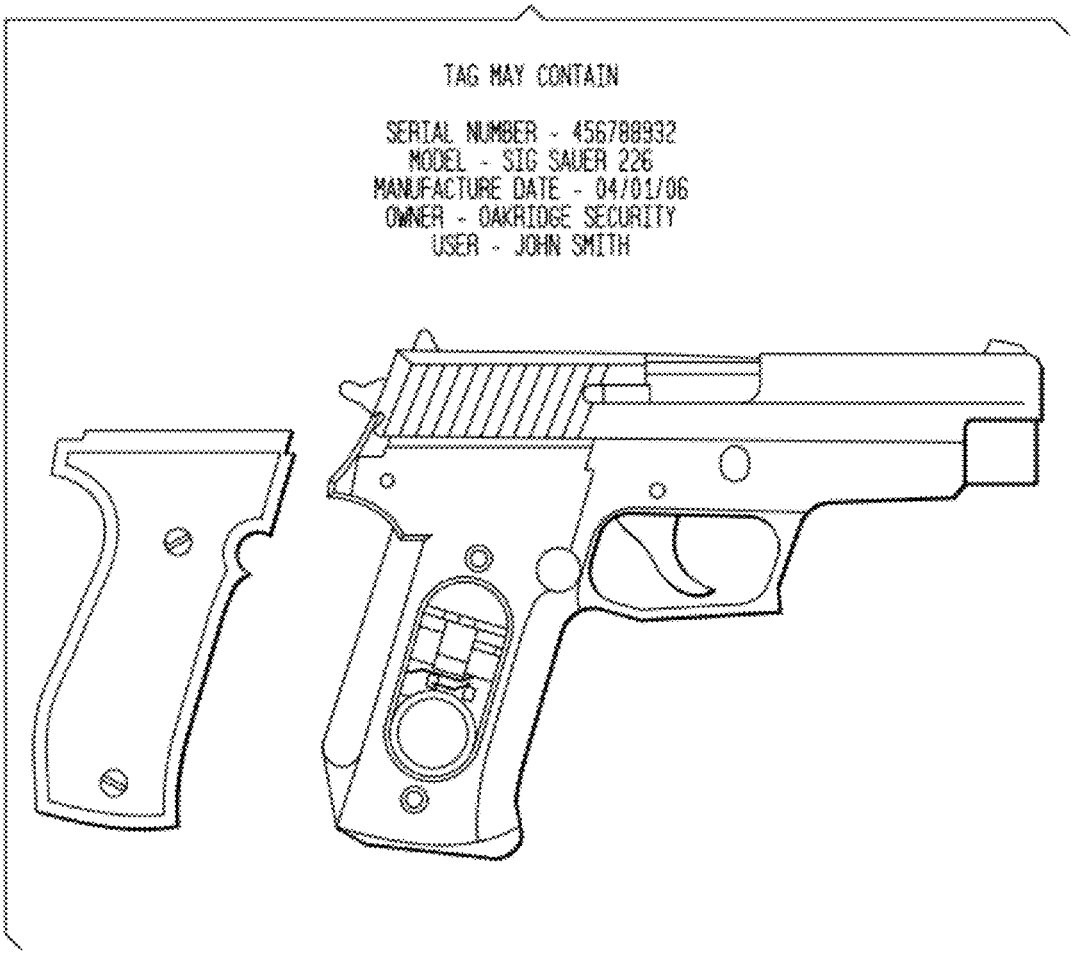
FIG. 2 shows an example of data that may be contained in the radio tag, according to an embodiment of the present invention.

Referring to FIG. 2 there is shown an example of some of the data that may be stored in the radio tag 100. In FIG. 2 there is listed a weapon serial number, a model, manufacture date, owner, and user of the weapon. It may be desirable to hide some or all of this data. This can easily be done using known encryption methods such as AES public/private key encryption. Also, the data may be secured by requiring a password.

The tag 100 may contain additional features and components as will be discussed here below.

Other Embodiments

The functionality of the tag 100 can be greatly enhanced with the addition of optional components. One of these optional components is a sensor 1150. The RuBee® chipset has the ability to detect and read analog voltages from various optional detectors 1150. Sensors 1150 may be included to provide positional information, use information, and other data to the microprocessor 1110. The number of sensors and the type of sensors depend on the intended use of the tag 100. For example, an activity parameter sensor may be used. The activity parameter sensor detects the number of shots fired by detecting the number of projectiles remaining in the cartridge. Another sensor 1150 may be able to detect if the tag 100 has been removed from the handgun. In fact, additional sensors may be placed on the back of the tag 100 for just this purpose. Each instance of motion and/or acceleration is a status event and it is detected by the sensor 1150. Sensors 1150 are ideal for providing an event history of the event statuses they detect. Other sensors not mentioned here may be advantageously used within the spirit and scope of the invention.

Figure 3:
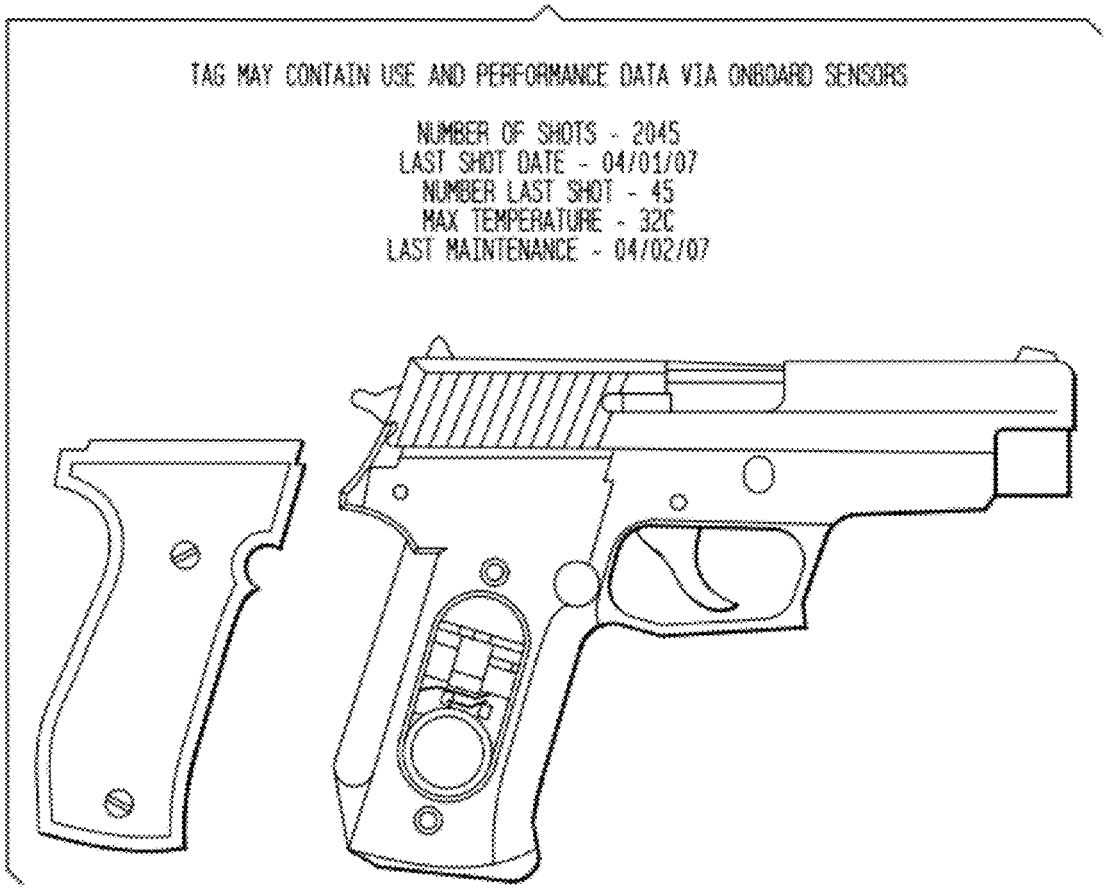
FIG. 3 shows an example of use and performance data contained in the radio tag, according to an embodiment of the present invention.

FIG. 3 shows an example of use and performance data that may be contained in the radio tag 100, as provided by the onboard sensors 1150. For example, the number of shots fired, the last shot date, the number of the last shot, the maximum temperature, and the last timestamp when maintenance was performed.

Additionally, a clock 1160 may be included inside the tag 100. The clock 1160 can provide a time history to correspond with status events detected by the sensors 1150. The clock 1160 can be configured to provide a time signal to correspond with a signal emitted by a sensor 1150. The processor 1110 records the time signal together with the sensor signal in order to provide a temporal history that can be mapped to a status history. The history data can be stored in the memory 1130 along with status events. Tying events to a time stamp provides for a more meaningful history of events. For example, mapping shots fired to a date and time affords very useful information.

The tag 100 may be programmed to emit a warning signal when at least one of the sensors 1150 detects a condition that meets a predetermined value. For example, a sensor 1150 in the tag 100 may emit a signal when the ammunition falls below a predetermined amount. A jog sensor 1150 may emit a signal when the weapon has been dropped. A signal could also be emitted when it is time to perform maintenance on the weapon.

To secure the stored data in the tag 100, an onboard crystal may be used to provide optical encoding using liquid crystal spatial light modulators. One-time pad ciphers are another security measure that can be advantageously used with a radio tag 100. Using known security measures with the radio tag 100 is recommended when needed to assure that the tag data does not fall into the wrong hands.

Figure 4:
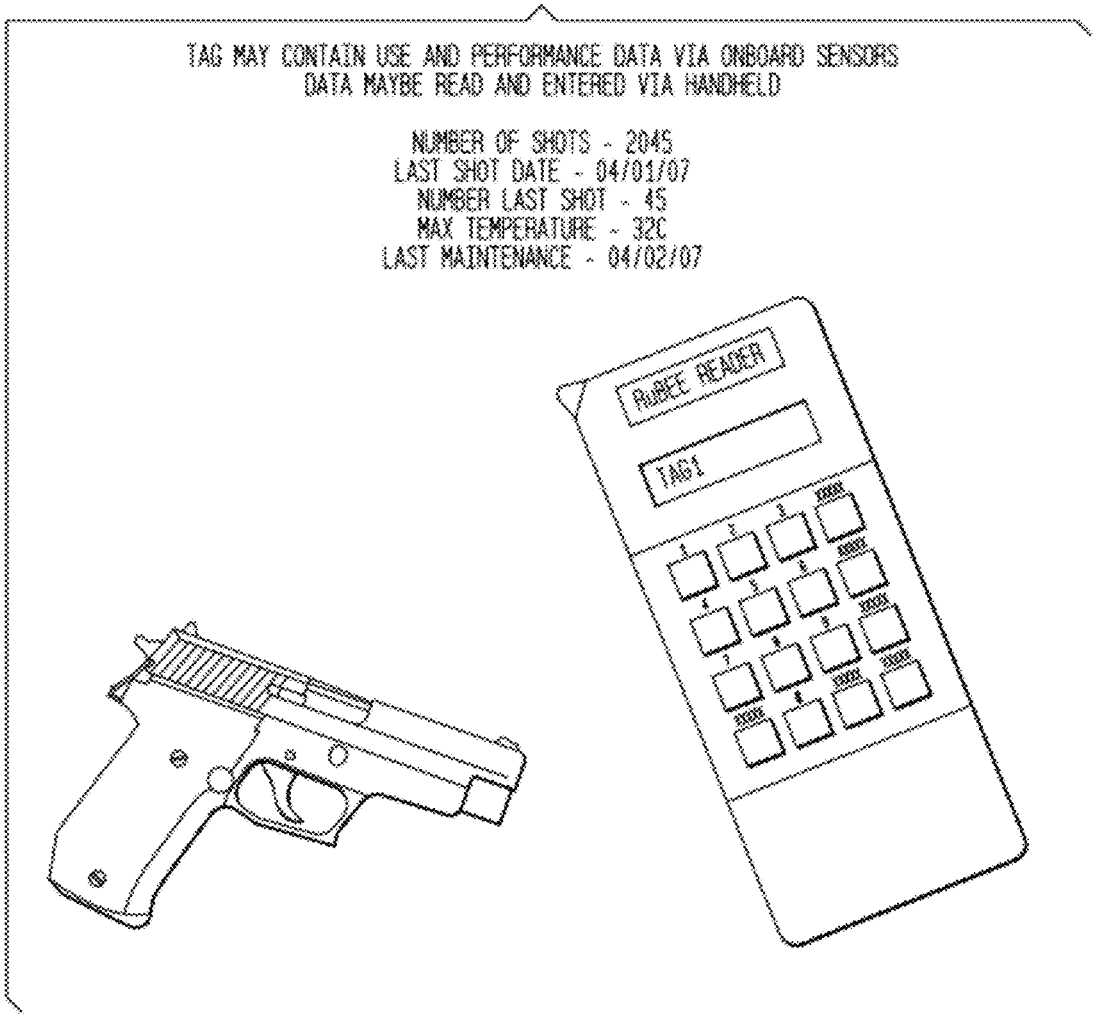
FIG. 4 shows a handheld reader configured to read the tag data, according to an embodiment of the present invention.

FIG. 4 shows a handheld reader that may be used to read and enter data to/from the radio tag 100. Although this method has the disadvantage of requiring an individual to be in proximity to the firearm, it has the advantage of being a low-cost way of quickly gathering data while out in the field and away from a computer. The handheld reader can be optimized with a USB port to facilitate downloading of data to a computer. The antenna 1180 within the tag 100 is operable up to approximately fifteen feet. Without any additional antennas, the handheld reader would need to be within a fifteen-foot range of the tag 100 and positioned correctly to pick up the transmitted signals from the tag 100. Of course, the transmission field of the tag antenna 1180 can be amplified by employing additional antennas as shown in FIG. 5.

The range of the tag 100 can be amplified exponentially using additional antennas. FIG. 5 shows an antenna layout using a loop antenna surrounding shelving where the handguns are placed. In this manner a full physical inventory can be easily maintained. Every time a weapon is placed in the shelving or removed from the shelving, a record could be produced providing the information of the weapon and the timestamp. See "Networked Tags for Tracking Files and Documents," U.S. Application Ser. No. 60/888,707, filed on Feb. 7, 2007, incorporated by reference as if fully set forth herein. The radio tags 100 are ideal for tracking inventory in this manner because they operate effectively around steel shelving.

Figure 5:
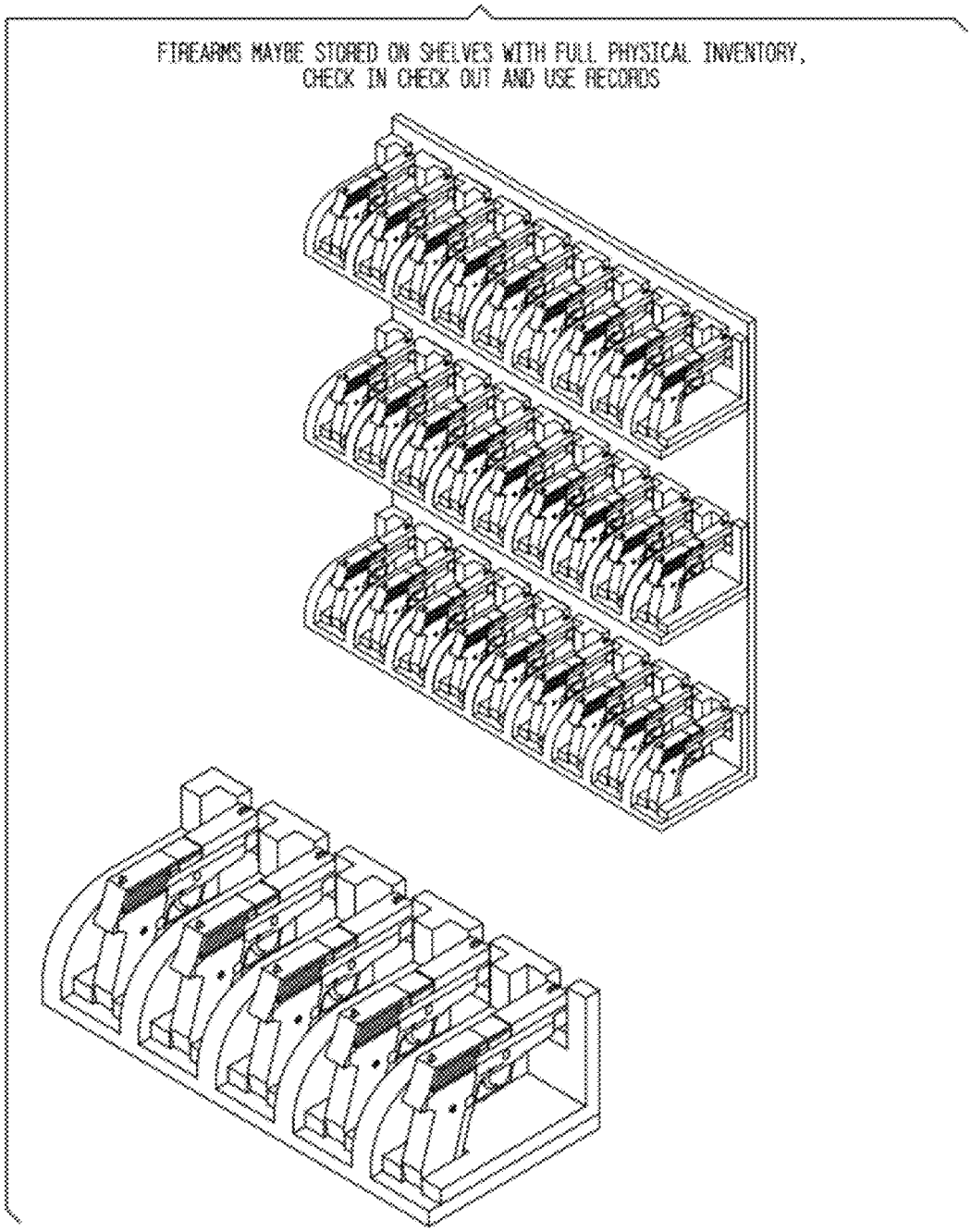
FIG. 5 shows an inventory of handguns on shelves configured with a loop antenna, according to an embodiment of the present invention.
Figure 6:
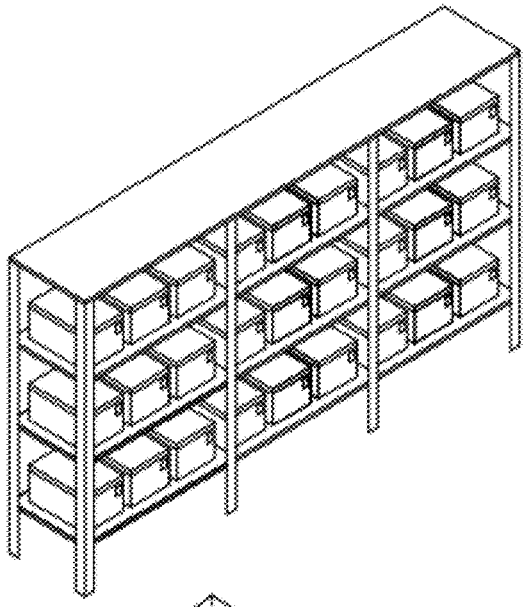
FIG. 6 shows another view of the visible shelves, according to an embodiment of the present invention.
Figure 6:
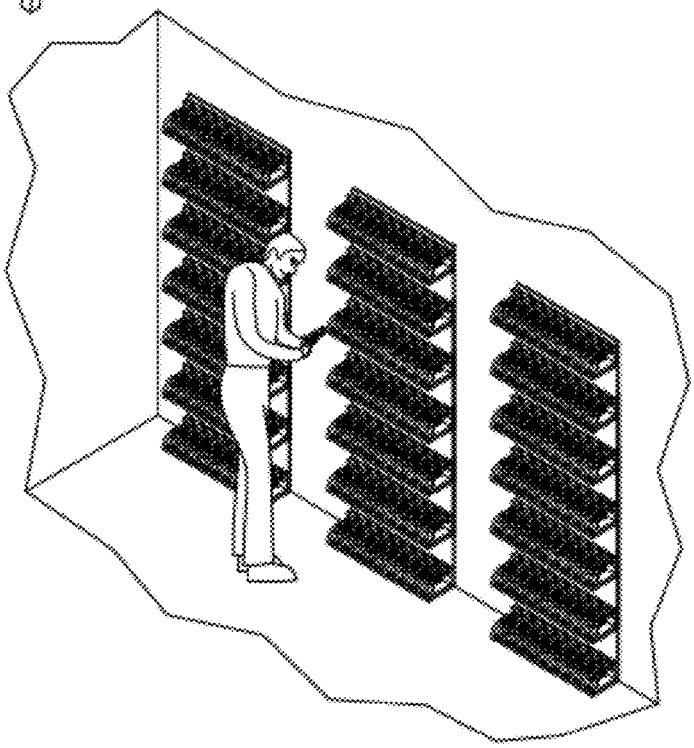

FIG. 6 shows another view of the shelves of FIG. 5. Also shown in FIG. 6 is a depiction of the firearm inventory stocked in their original boxes. This is another option with the visibility network. The boxes may contain radio tags that provide data picked up by the shelves or a remote reader. The tags can be easily integrated into a package, file folder, or box.

The router 1190 of FIG. 1 is a custom RuBee® router. RuBee® routers are designed to read data from multiple antennas at a low frequency. The router 1190 has a built-in GPS unit, two USB ports, a serial port and high-speed Ethernet connection for communication with the central data processor 380. This enables the data stored in the tags 100 to be accessed remotely via a web-enabled computer 380. At any point in time, data about any of the firearms (or all of the firearms) within the network can be accessed real-time through a web browser.

Figure 7:
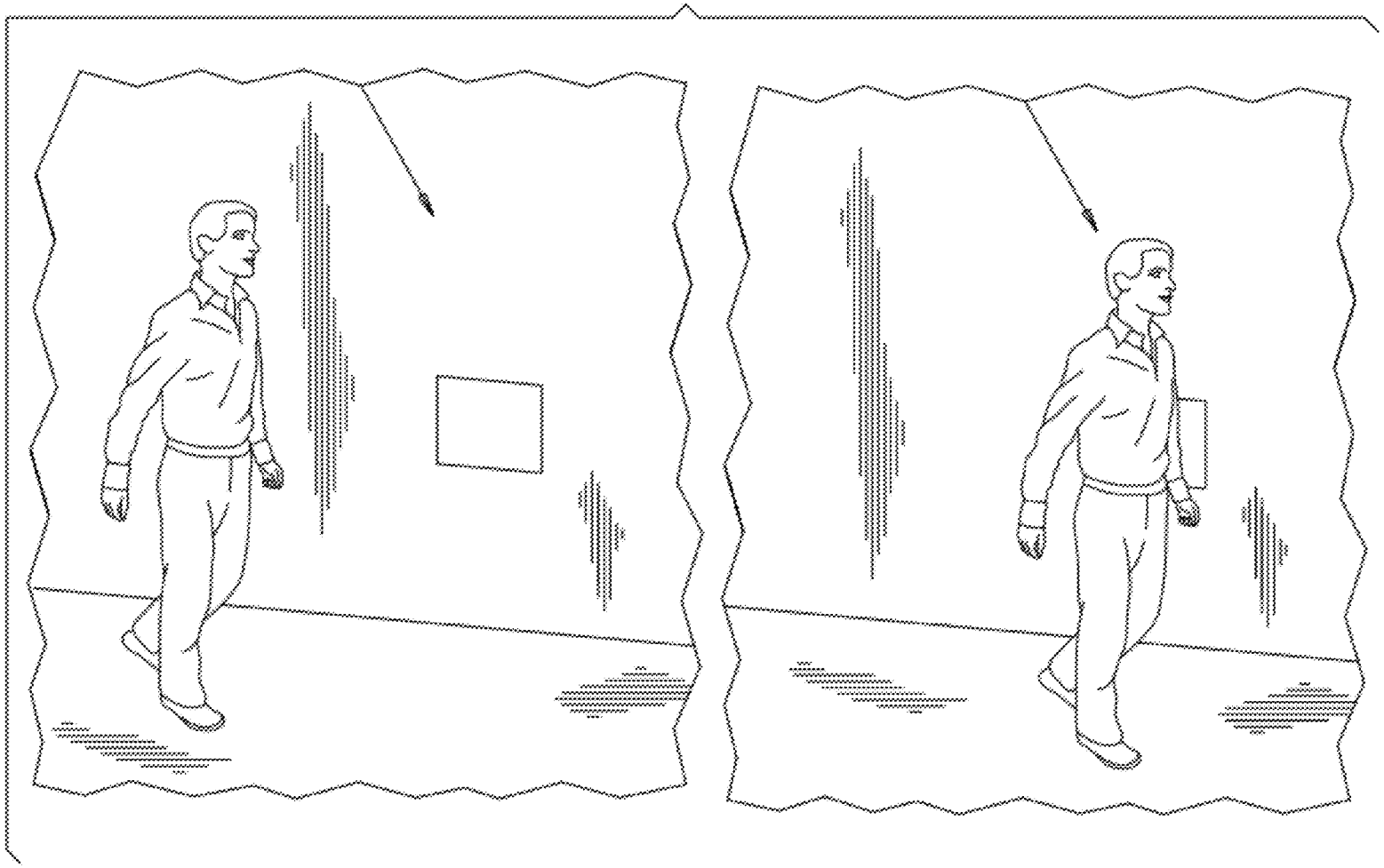
FIG. 7 shows an example of a wall-mounted portal, according to an embodiment of the present invention.

FIG. 7 shows a wall-mounted portal configured to read data from the radio tag 100. As shown in FIG. 7, as an individual carrying a radio tag 100 enabled weapon passes within close proximity to the portal, the portal, or reader, is able to read the data from the radio tag 100. This example shows that the portal has detected that handgun 33456789, carried by John Smith, was in close proximity to the portal on Apr. 4, 2007 at 12:36 p.m. Note that this data could be read directly from the tag 100 embedded in John Smith's handgun. In an alternate embodiment, however, the data from the weapon could be paired with data from an identification card carried by the entity in possession of the handgun. The advantage of the wall-mounted portal as shown in FIG. 7 is that it is inexpensive and very easy to set up.

Figure 8A:
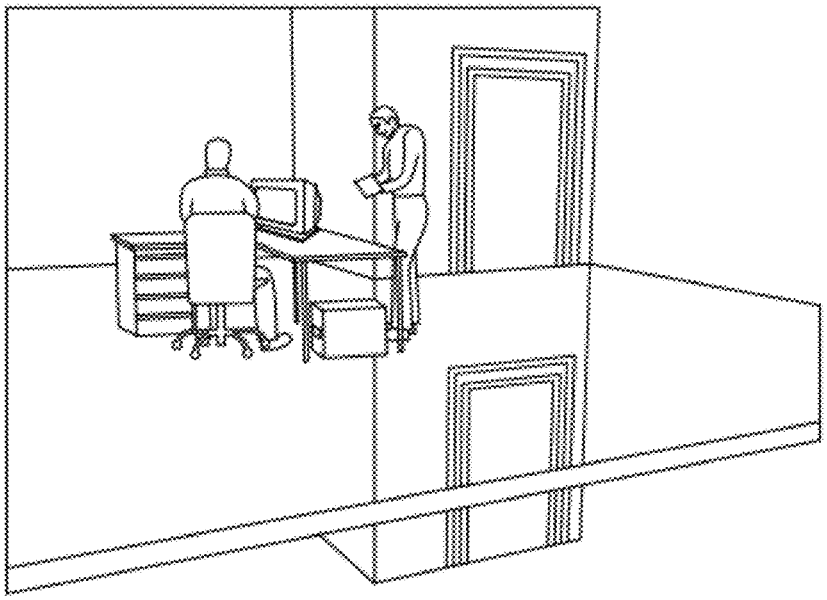
FIG. 8 shows an example of a strategically placed loop antenna, according to an embodiment of the present invention.
Figure 8B:
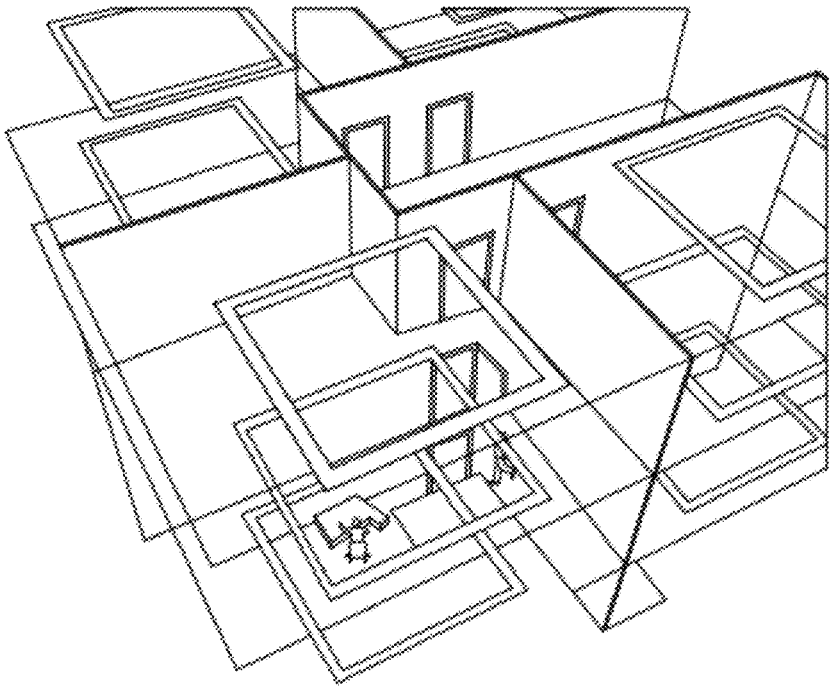

FIG. 8 shows another embodiment wherein a large loop antenna is strategically placed in a building in order to read data from the tags 100 as they come within range of the antenna. FIG. 8*a* shows one embodiment wherein the loop antenna is placed around a doorway. In another embodiment as shown in FIG. 8*b*, the antenna may be placed horizontally either on a floor or ceiling within a building or even an outdoor area.

Figure 9:
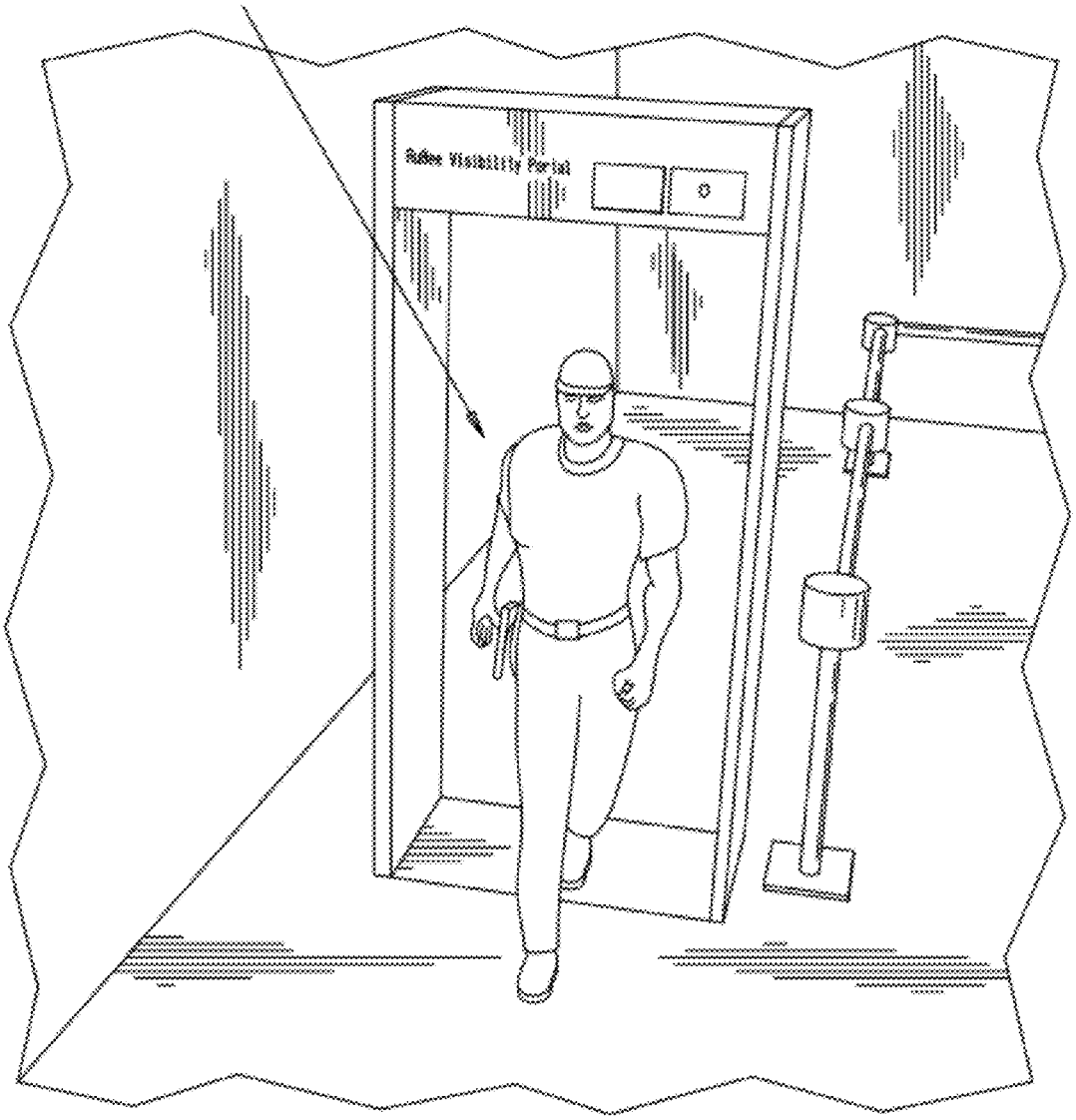
FIG. 9 shows an example of a visibility portal, according to an embodiment of the present invention.

Another option for providing real-time visibility is to use a standard visibility portal configured to read radio tags 100, as shown in FIG. 9. Data may be read from a radio tag 100 in possession of an individual walking through the portal.

To facilitate the matching of the weapon to the carrier of the weapon, a networked identification card may be carried by the weapon user. The identification card is also RuBee® enabled and can store upwards of 1,000 bytes. The card shown here is in a credit card form factor. This card was described in U.S. Patent Application Ser. No. 60/889,902, entitled "Two-Tiered Networked Identification Cards" and filed on Feb. 14, 2007, incorporated by reference as if fully set forth herein.

The data storage within the tag 100 can store all of the information necessary to identify the weapon, its owner/carrier and its event history. Some of the data fields for weapon identification may include: a unique identifier for the weapon, its date of purchase, its location, its affiliation (such as police department), and its current maintenance status. Note that this is merely a representative sampling of the data which can be stored in a tag 100. As stated earlier, the data stored in the tags 100 is easily accessible via a handheld reader as shown in FIG. 4, or a computer. This presents a problem of securing this data so that it does not fall into the wrong hands. The data can be protected by assigning a personal identification number (PIN) so that only those users with the PIN can access the data. Alternatively, the data may be encrypted with Advanced Encryption Standard (AES) encryption. Only authorized personnel would have the key to decrypt the data.

Figure 10:
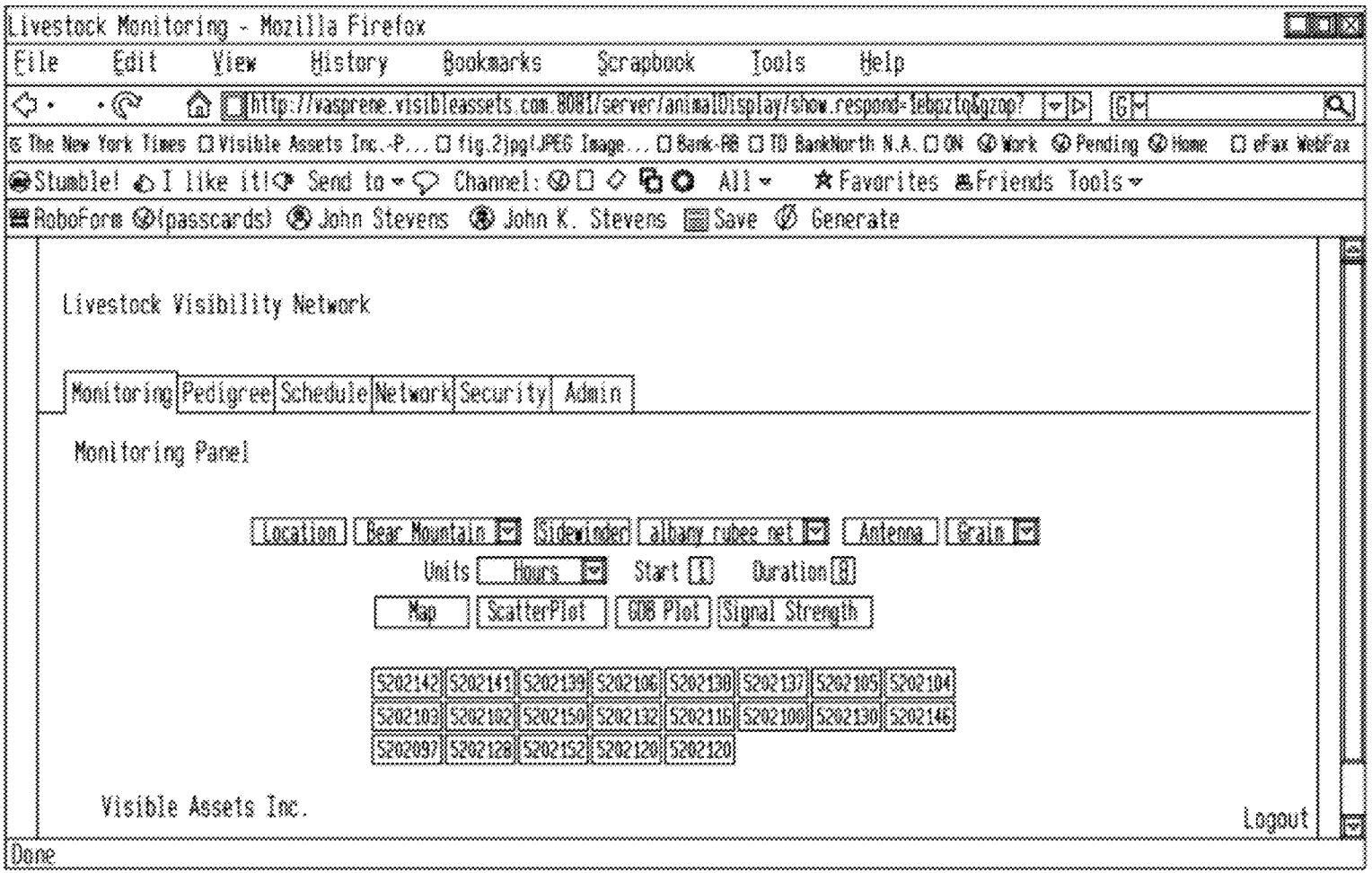
FIG. 10 shows an example of a web-enabled report, according to an embodiment of the present invention.

FIG. 10 is a screenshot of a proprietary database system configured to process the data from the tags 100. IEEE P1902.1 offers a real-time, tag-searchable protocol using IPv4 addresses and subnet addresses linked to asset taxonomies that run at speeds of 300 to 9,600 Baud. RuBee® Visibility Networks are managed by a low-cost Ethernet enabled router 1190. Individual tags and tag data may be viewed on a stand-alone system or a web server from anywhere in the world. Each RuBee® tag, if properly enabled, can be discovered and monitored over the World Wide Web using popular search engines (e.g., Google) or via the Visible Asset's .tag Tag Name Server.

Gathering information about one weapon is important. Equally important, if not more so, is gathering information about all of the weapons within a network. Note that in this discussion we refer to a "network" of weapons as all of the weapons within one networked RuBee® tag system. A network of weapons may or may not be restricted to one affiliation (such as a police department) or group of weapons (all revolvers). It is critical to track the shots fired, event histories, and condition of a network to be able to predict future events and to know what conditions will need to be changed and/or further monitored. It is well known in the art of database software that manipulating data in different ways produces different views of the data. Data from RuBee® tags 100 can be used for various purposes within the scope of this invention.

Optionally, a global positioning unit (GPS) 1195 may be operatively connected to the router 1190 to pick up the position signals detected by the tag's 100 optional positional sensor 1150 and record that information. The router 1190 and GPS 1195 unit can be placed in separate locations or may be co-located in a strategic location for optimal visibility of the firearm.

Figure 12:
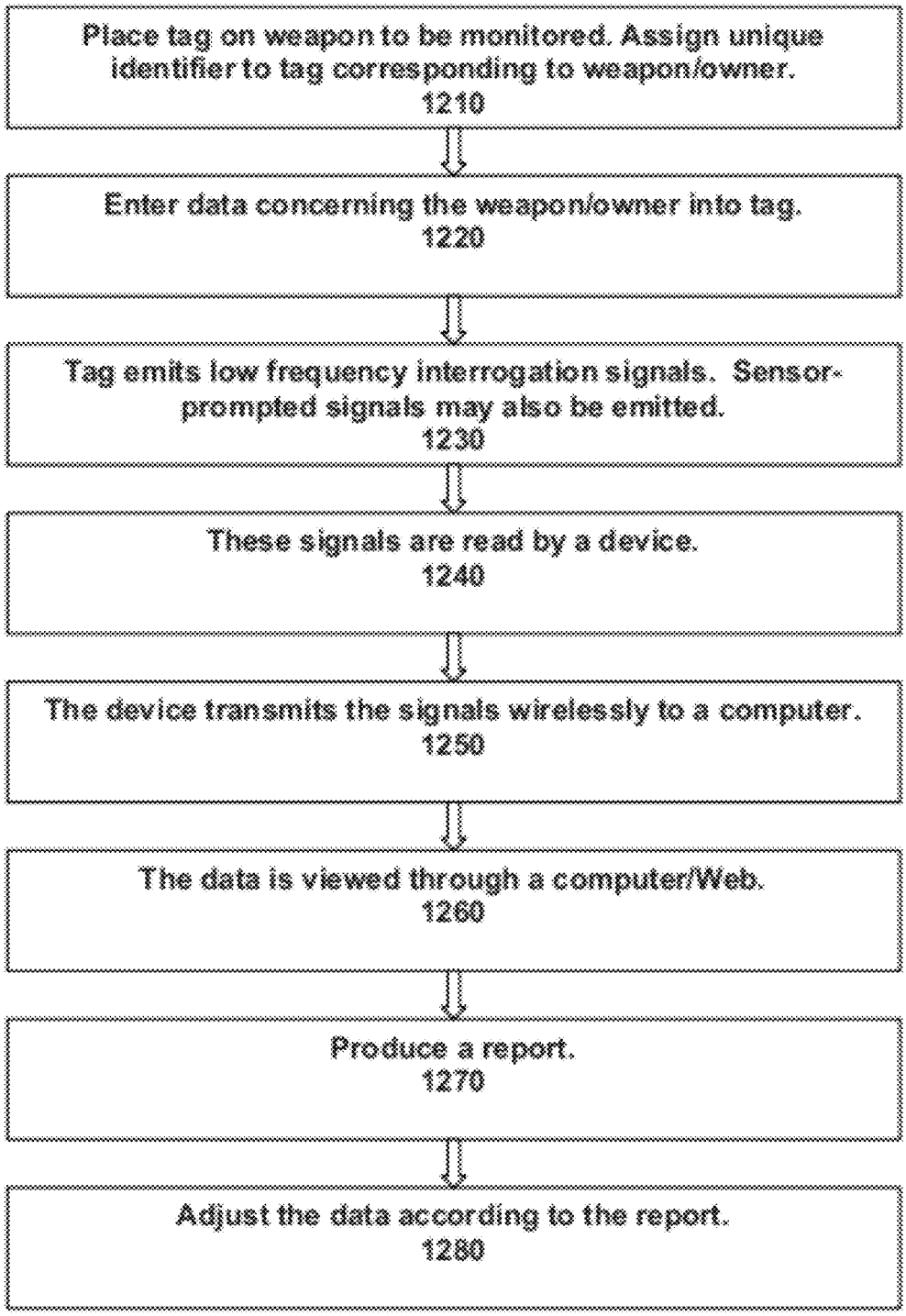
FIG. 12 is a flow chart of the process for implementing radio tags on firearms, according to an embodiment of the present invention.

FIG. 12 is a flow chart 1200 of the process of implementing RuBee™-enabled tags to provide automatic, remote, and wireless identification, monitoring, and tracking of weapons, according to the present invention. The process begins at step 1210 when a tag 100 is attached to a weapon. The tag 100 may be securely embedded in a firearm as shown in FIG. 1, or it may be affixed to the firearm in such a way that it is easily removable. A unique identifier is assigned to the tag 100. This unique identifier corresponds to the weapon to which the tag 100 is attached. The identifier can be programmed into the tag 100 either before or after it is attached.

Next in step 1220, other data concerning the weapon is entered. This data may be the model number, the purchase date, the affiliation (agency, police department), and/or the maintenance record of the weapon, to name just a few data items that can be stored in the tag 100. The tag 100 is enabled to constantly transmit low frequency radio signals through its modem 1120. In step 1230 the identification data from the transceiver 1120 of the radio tag 100 is interrogated by the radio tag 100 with radio frequency interrogation signals at a low radio frequency not exceeding 450 kilohertz. The radio tag 100 may also transmit a signal or signals upon detection of a status event, such as a change in ammunition status of the weapon.

In step 1240 these signals are picked up by a reader operable to receive low frequency radio signals below 450 kilohertz within range of the tag antenna 1180. The reader may be a handheld reader, such as a wand reader. The signals may also be picked up by a router 1190, or another tag in the network.

In step 1250 the reader, router 1190, or handheld reader transmits the data via a wireless connection to a computer. The data may be encrypted with known encryption methods.

In step 1260 the transmitted data, after it is decrypted, if necessary, is viewable through a computer. The data may be accessed from a database configured to process the tag data and displayed through a computer monitor, or a personal digital assistant (PDA) screen, a cell phone display, or any other display means according to advancing technology. The data may also be viewable via web browser. When the data is available on the Internet, it then becomes critical to safeguard the data, either by requiring a login and password, or using data encryption methods known in the art. In one embodiment, the login name may be the serial number of the weapon.

In step 1270, the data gathered from the tag 100 or all of the tags in the network may be compiled into a report such as that shown. The report may be confined to one particular weapon, showing event and time histories for that weapon, or it may report on some or all of the weapons within an inventory shelf or a network. The report may be produced daily, monthly, seasonally, or yearly. The report may be automatically generated or may be generated upon user request. Optionally, a report may be auto-generated according to data received from the tag 100 which meets a pre-determined condition. For example, a user might want a report on a particular weapon generated when an ammunition sensor registers that the weapon has been fired. The report may be viewable on the Internet and/or distributed to appropriate personnel.

The purpose of generating reports is to provide information which can be used for predicting future trends and/or improving a situation, and/or for analyzing performance. Information gathered from a report may indicate that a change is necessary. The change may be a change in the data entered into the tag 100, or the data collected by the tag 100, or the position and/or frequencies of the equipment used to read the tags 100. You will recall that RuBee® tags 100 are programmable, unlike RFID tags 100.

Therefore, in step 1280 information gathered from a report may be used to add to or change the programming of the tags. To implement this, a user would make any needed changes on a computer. The data is transmitted to a RuBee® router 1190 which in turn communicates with a radio tag 100 through an antenna (either the tag antenna directly or a field antenna). The modem 1120 of the tag 100, using the chipset 1125 transmits the signals to the processor 1110. The processor 1110 records the data and makes the necessary changes. Many other additions and modifications can be made to the data to assist an end user in monitoring and tracking weapons within a network.

As has been presented herein, the RuBee® networked tags 100 provide remote, wireless tracking of weapons and perhaps ammunition. They facilitate real-time reporting on a specific weapon, cache of weapons, inventory, or region. Information on a specific weapon can be easily accessed through the internet simply by entering a unique identifier for that weapon, such as its tag ID number.

Therefore, while there has been described what is presently considered to be the preferred embodiment, it will understood by those skilled in the art that other modifications can be made within the spirit of the invention. The above descriptions of embodiments are not intended to be exhaustive or limiting in scope. The embodiments, as described, were chosen in order to explain the principles of the invention, show its practical application, and enable those with ordinary skill in the art to understand how to make and use the invention. It should be understood that the invention is not limited to the embodiments described above, but rather should be interpreted within the full meaning and scope of the invention.

We claim:

1. A system for identifying, monitoring, and tracking a firearm, the system comprising:

a low frequency radio tag affixed to the firearm, said radio tag configured to receive and send data signals, the radio tag comprising:

a tag antenna operable at a low radio frequency not exceeding 450 kilohertz, a transceiver operatively connected to the tag antenna, said transceiver configured to transmit and receive data signals at the low radio frequency;

a data storage device configured to store data comprising identification data for identifying the firearm;

a processor configured to process data received from the transceiver and the data storage device and to transmit data to cause said transceiver to emit an identification signal based upon the identification data stored in said data storage device;

a connector for a power source to power the processor and the transceiver; and an onboard crystal used for data encryption.

2. The system of claim 1, wherein the low radio frequency does not exceed 300 kilohertz.

3. The system of claim 1 wherein the identification data comprises an internet protocol address, and the processor is operable for communication with an internet router using said internet protocol address, such that at least a portion of the identification data can be transmitted through the internet router to be viewable through a web browser.

4. The system of claim 1, wherein the radio tag further comprises at least one sensor operable to generate a status signal upon sensing a pre-determined status condition.

5. The system of claim 4, wherein another radio tag within a network is operable to receive the status signal through its transceiver and wherein the another radio tag is operable to respond to this signal.

6. The system of claim 4 wherein the transceiver is operable to automatically emit a warning signal at the low radio frequency upon generation of the status signal by the at least one sensor.

7. The system of claim 6, wherein the radio tag further comprises: a clock operable to generate a time signal corresponding to the status signal, and wherein the data storage device is operable to store corresponding pairs of status and time signals as a temporal history of events corresponding to the firearm.

8. The system of claim 7, wherein the transceiver is operable to automatically transmit the temporal history at the low radio frequency upon receipt by said transceiver of a data signal that corresponds to the identification data stored in the data storage device.

9. The system of claim 1, further comprising the energy source operable for activating the transceiver and the processor.

10. The system of claim 1, further comprising: a reader in operative communication with the tag antenna, said reader configured to receive data signals from the radio tag.

11. The system of claim 10, further comprising: at least one field antenna disposed at an orientation and within a distance from the radio tag that permits effective communication therewith at the low radio frequency.

12. The system of claim 11, wherein the at least one field antenna comprises a large loop, wherein a distance from the at least one field antenna to the tag does not exceed a major dimension of said large loop.

13. The system of claim 11 wherein the at least one field antenna is positioned vertically.

14. The system of claim 11 wherein the at least one field antenna is a loop antenna.

15. The system of claim 1, further comprising: a transmitter in operative communication with the tag antenna, said transmitter being operable to send data signals to the radio tag.

16. The system of claim 15 wherein the transmitter is in communication with an at least one field antenna.

17. The system of claim 10 wherein the reader, an at least one field antenna, and a transmitter are combined into a handheld device configured for reading and transmitting signals to and from the radio tag.

18. The system of claim 11 wherein the at least one field antenna, the reader, and a transmitter are combined into a handheld device configured for reading and transmitting signals to and from the radio tag.

19. The system of claim 15 wherein the transmitter, at least one field antenna, and a reader are combined into a handheld device configured for reading and transmitting signals to and from the radio tag.

20. The system of claim 10 further comprising: a central data processor in operative communication with the reader.

21. The system of claim 15, further comprising: a central data processor in operative communication with the transmitter.

22. A reader for identifying, monitoring, and tracking a firearm, said reader comprising a low frequency transceiver configured to receive and send encrypted data signals to a radio tag operating at a low frequency, said radio tag being affixed to the firearm.

23. The reader of claim 22, the reader further comprising: at least one field antenna disposed at an orientation and within a distance from the radio tag that permits effective communication therewith at the low radio frequency.

24. A method for identifying, tracking and monitoring a firearm, said method comprising steps of:

attaching a low frequency radio tag to the firearm, said radio tag comprising a tag antenna operable at a low radio frequency not exceeding 450 kilohertz, a transceiver operatively connected to said antenna, said transceiver being operable to transmit and receive data signals at said low radio frequency, a data storage device configured to store data comprising identification data for identifying said radio tag, a processor operable to process data received from said transceiver and said data storage device and to send data to cause said transceiver to emit an identification signal based upon said identification data stored in said data storage device, and a connector for an energy source for activating said transceiver and said processor, and an onboard crystal used for data encryption;

storing, in the data storage device of the radio tag, data comprising identification data relating to said firearm;

reading the identification data from the transceiver of the radio tag by interrogating said radio tag with radio frequency interrogation signals at a low radio frequency not exceeding 450 kilohertz via said tag antenna; and storing encrypted data.

25. The method of claim 24, further comprising a step of: transmitting the identification data from the radio tag to a central data processor.

26. The method of claim 25 further comprising a step of: transmitting the data such that the data is viewable via web browser.

27. The method of claim 24 further comprising a step of: generating a report detailing the transmitted data.

28. The method of claim 24 wherein the storing step further comprises storing a unique identifier corresponding to the firearm, the unique identifier stored in the data storage device.

29. The method of claim 28 wherein the unique identifier is used as a key to access data about the firearm.

30. The method of claim 24 further comprising a step of: receiving a status signal from at least one sensor located in the radio tag, the at least one sensor operable to generate a status signal upon sensing a pre-determined status condition.

31. The method of claim 30, further comprising a step of: receiving a time signal corresponding to the status signal, said receiving step further comprising steps of: receiving stored corresponding pairs of status and time signals as a temporal history of events experienced by the firearm; and receiving the temporal history at said low radio frequency.

32. The method of claim 31, wherein the step of receiving a time signal is performed automatically upon receipt by the transceiver of the status signal.

33. The method of claim 32 further comprising a step of emitting a warning signal upon receipt of the status signal.

34. The method of claim 27 further comprising a step of transmitting signals to the radio tag to cause the processor to modify its programming, in response to information contained in the report.

* * * * *